United States Patent [19]

Johnson

[11] 4,164,795

[45] Aug. 21, 1979

[54] PORTABLE URINAL

[76] Inventor: Ernest K. Johnson, 91119 Hill Rd., Springfield, Oreg. 97477

[21] Appl. No.: 929,031

[22] Filed: Jul. 28, 1978

[51] Int. Cl.[2] ..... A47K 11/00

[52] U.S. Cl. ..... 4/144.1; 4/144.2; 4/144.3; 4/144.4; 4/114.1; 241/257 G

[58] Field of Search ..... 4/144.1, 144.2, 144.3, 4/114.1, 144.4, 113.1, 112; 241/257 G; 128/2 F, 276; 222/567

[56] References Cited

U.S. PATENT DOCUMENTS

| | | | |
|---|---|---|---|
| 230,167 | 7/1880 | Bard | 222/567 |
| 703,131 | 6/1902 | Jaenel | 4/144.3 |
| 1,337,829 | 4/1920 | Doyle | 4/113.1 |
| 2,815,511 | 12/1957 | Friedman et al. | 4/144.1 |
| 3,163,869 | 1/1965 | Johnson et al. | 4/144.1 |
| 3,422,463 | 1/1969 | Lowry | 4/144.1 |
| 3,471,870 | 10/1969 | Segal | 4/144.1 X |
| 3,672,547 | 6/1972 | Kazlowski | 222/567 |
| 3,855,997 | 12/1974 | Sauer | 128/2 F |

FOREIGN PATENT DOCUMENTS

| | | | |
|---|---|---|---|
| 29576 | of 1910 | United Kingdom | 4/144.1 |

*Primary Examiner*—Henry K. Artis
*Attorney, Agent, or Firm*—Lee R. Schermerhorn

[57] ABSTRACT

The urinal has an inlet tube which, when properly assembled on its container, will not discharge the contents of the container. The inlet tube is removable for emptying and washing the container and a special form of connection is provided to insure that the tube is always replaced in the container in the proper manner to prevent spillage.

8 Claims, 5 Drawing Figures

PORTABLE URINAL

BACKGROUND OF THE INVENTION

This invention relates to a portable urinal and involves certain improvements over the device illustrated and described in U.S. Pat. No. 3,163,869.

The urinal in said patent has a spill-proof inlet tube which will not discharge the contents of the container when the tube is properly assembled in the container. A removable screw cap is provided for emptying the container so that there is no necessity for removing the tube for this purpose.

In practice, however, it is found that hospital attendants frequently remove the tube instead of the cap when emptying the container. Then, if the tube is not properly oriented when replaced in the container, some spillage through the inlet tube or its associated air vent tube could result after subsequent use of the urinal.

The objects of the present invention are, therefore, to provide an improved spill proof urinal in which the inlet tube cannot be improperly assembled in the container so as to result in spillage, and to provide a novel and improved connection between the inlet tube and container which will allow the tube to be assembled in only one rotative position in the container.

SUMMARY OF THE INVENTION

In the present construction the connector parts are arranged so that they will fit together in only one rotative position of the inlet tube whereby improper assembly of the tube and subsequent spillage are prevented. The tube is connected to the container by a simple twist through a small angle making the parts quick and easy to assemble without any possibility of improper assembly.

The present arrangement makes it possible to eliminate the previous screw cap provided on one end of the container for emptying the urinal. This simplifies the construction and allows for the provision of a flat supporting surface on that end for standing the urinal on end, which is an added convenience in handling and storing a large number of the urinals.

The invention will be better understood and the foregoing and other objects and advantages will become apparent from the following description of the preferred embodiment illustrated in the accompanying drawing. Various changes may be made however in the details of construction and arrangement of parts and all such modifications within the scope of the appended claims are included in the invention.

DESCRIPTION OF THE PREFERRED EMBODIMENT

Figure 1:
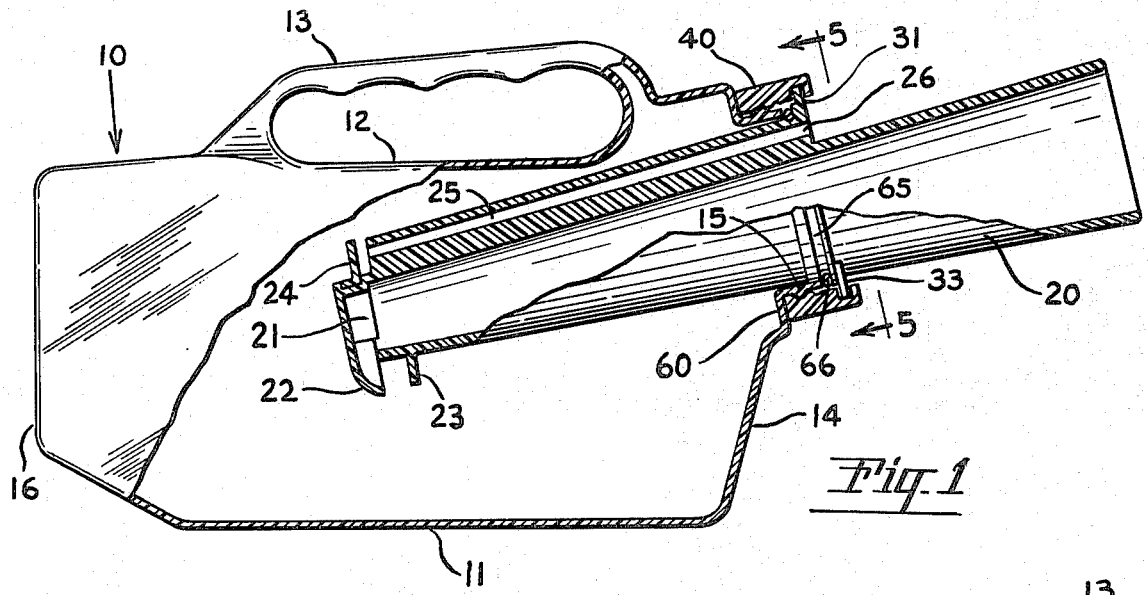
FIG. 1 is a side elevation view with parts in section showing a portable urinal embodying the invention.

The container 10 is preferably integrally molded in one piece from a suitable plastic material. Container 10 has a flat bottom side 11, a top side 12 with a handle 13, a front end 14 with a screw threaded neck portion 15 and a flat back end 16. Neck 15 provides the only opening in the container.

The cylindrical neck 15 has an axis slightly inclined from horizontal for mounting a molded plastic inlet tube 20 having an inner end 21 disposed at the volumetric center of the container. This inner end of the tube 20 is equipped with splash guards 22, 23 and 24 as described in said patent.

An air vent tube 25 extending along the top side of tube 20 is molded as an integral part of tube 20. The upper end 26 of vent tube 25 is open to atmosphere. To assist the operator in assembling tube 20 in container 10 the word "TOP" is molded in the top surface of the external portion of tube 20 adjacent the end 26 of vent tube 25 as indicated at 27 in FIG. 2.

An eccentric peripheral flange 30 is also molded integrally with inlet tube 20 and vent tube 25. Flange 30 includes four radial lugs 31, 32, 33 and 34, the upper end 26 of vent tube 25 opening through the top lug 31. Lug 31 is narrower than the lugs 32, 33 and 34.

Figure 4:
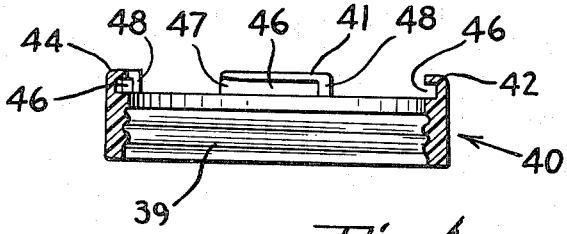
FIG. 4 is a view on the line 4—4 in FIG. 3.

A plastic coupling ring 40 is molded with a screw thread 39 for mounting on the screw threaded neck 15. Coupling 40 has four forwardly extending axial projections 41, 42, 43 and 44, each containing an internal circumferential groove 46 to receive one of the lugs just described. Each groove 46 has a widened entrance end 47 and a closed terminal end 48 as shown in FIG. 4.

The projections 41, 42, 43, and 44 are separated by circumferential spaces 51, 52, 53 and 54 to receive the lugs 31–34 in positions for the lugs to be rotated clockwise into grooves 46 for securing tube 20 in the container. Space 51 is narrower than spaces 52, 53 and 54 to receive the narrow top lug 31 for clockwise rotation into the groove 46 of top projection 41. Space 51 is too narrow to receive the wider lugs 32, 33 and 34 whereby the tube 20 must be properly oriented before it can be connected to container 10. Space 51 is made narrow by making projection 44 wider than the other projections 41, 42 and 43.

Figure 2:
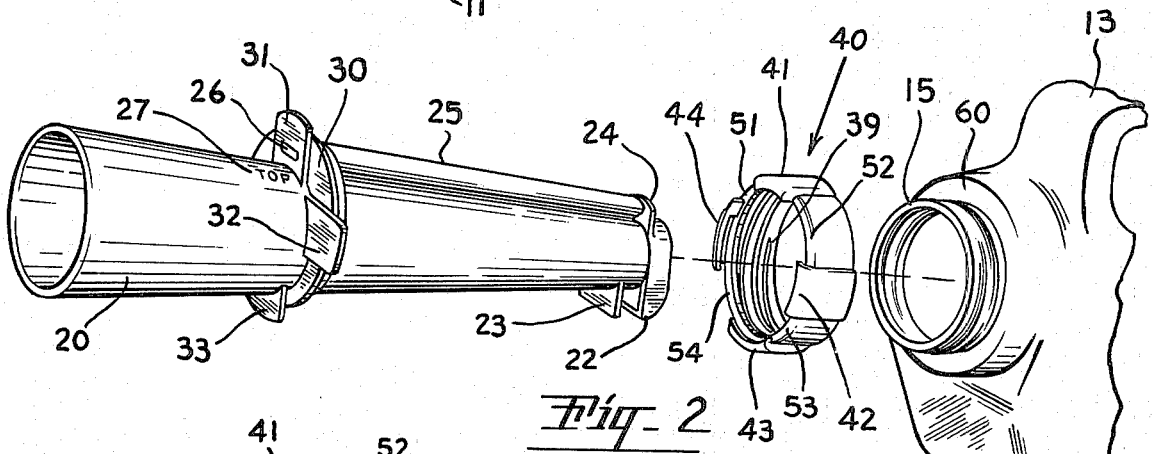
FIG. 2 is an exploded perspective view.
Figure 3:
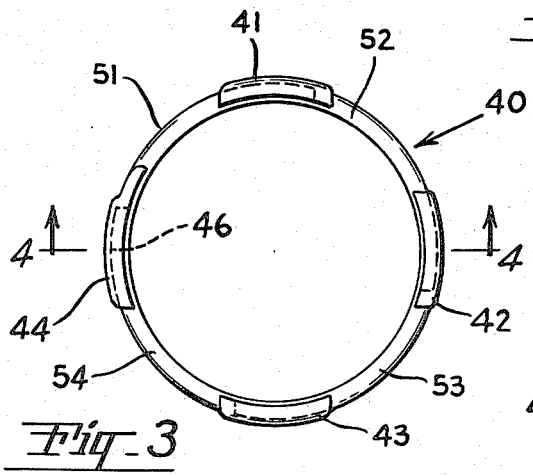
FIG. 3 is an end view of the coupling.
Figure 5:
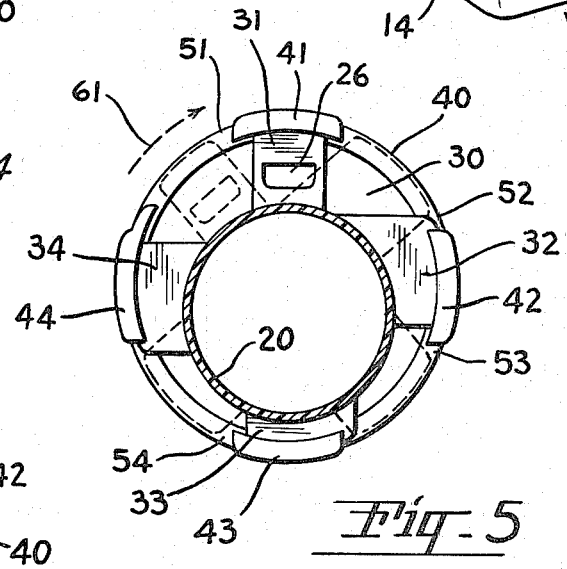
FIG. 5 is a view on the line 5—5 in FIG. 1.

Proper orientation of inlet tube 20 to prevent spillage requires that vent tube 25 be in top position as shown in FIGS. 1, 2, and 5. This position is assured by molding the thread 39 on coupling 40 so that projection 41 will be top position when coupling 40 is tightened on neck 15 causing the coupling to seat solidly against the shoulder 60 on the container. This places the narrow space 51 at the entrance end of groove 46 in projection 41 as shown in broken lines in FIG. 5, the clockwise rotation of the lug 31 into the groove in projection 41 being indicated by arrow 61. Such rotation through a small angle also turns the lugs 32, 33 and 34 into the corresponding grooves in projections 42, 43 and 44 to provide secure attachment of tube 20 to the container at four points around the circumference of the tube.

It is apparent in FIGS. 1, 2 and 5 that flange 30 and coupling 40 are eccentric to inlet tube 20. On the inner side of flange 30 is a circumferential groove 65 to receive a resilient rubber O-ring 66. O-ring 66 serves as a gasket to seal flange 30 against the neck 15 of the container and also provides an axial frictional force to hold the lugs 31–34 securely in the grooves 46 so that the lugs and tube 20 cannot rotate freely and accidentally disengage the tube from the container. At the same time, the tube 20 is quickly and easily removable by a counter-clockwise twist through a small angle to empty the container. Once installed, the coupling 40 may remain a permanent part of container 10 and need never be removed except possibly for cleaning and sterilizing, as desired.

The elimination of a separate drain outlet and cap on the back end 16 allows a flat supporting surface on this end for standing the container in upright position with tube 20 projecting upward when desired.

What is claimed is:

1. A urinal comprising a container having top and bottom sides and a circular opening in one end thereof, an approximately horizontal removable inlet tube having one end insertable into said opening, an eccentric circular flange on said inlet tube arranged to seal against the margin of said opening, a plurality of radial lugs outstanding from said flange, a plurality of axial projections mounted in fixed positions around the periphery of said opening, circumferential grooves in said projections to receive said lugs in rotary movement for mounting said inlet tube in the container, and circumferential spaces between said projections to admit said lugs into said grooves, the circumferential widths of said lugs, projections and spaces being non-uniformly arranged to admit said lugs into said grooves for connection of said inlet tube with said container in only one rotative position of the inlet tube.

2. A urinal as defined in claim 1, one of said lugs being narrower than the other lugs and the space to receive said narrow lug being too narrow to receive said other lugs, to insure the correct rotative position of said inlet tube in the container.

3. A urinal as defined in claim 1 including a resilient gasket to seal said flange against said margin of said opening and impose frictional restraint against rotation of said inlet tube in the container.

4. A urinal as defined in claim 1, said opening being in a screw threaded neck on said container, and a coupling having a screw thread arranged to tighten on said neck thread in a predetermined orientation of said coupling, said axial projections being on said coupling.

5. A urinal as defined in claim 1, the opposite end of said container being flat to support the container in upright position with said inlet tube projecting upward.

6. A urinal comprising a container having top and bottom sides and a screw threaded neck on one end of the container, a coupling having a screw thread arranged to tighten in a predetermined orientation on said neck thread, circumferentially spaced axial projections on said coupling, a circumferential groove in each of said projections, an inlet tube insertable into said neck, an air vent tube extending along one side of said inlet tube and integral therewith, a circular flange on said inlet tube having radial lugs insertable into the spaces between said projections for rotation into said grooves to mount said inlet tube in the container, and means to accept said inlet tube for said mounting in only one rotative position of said inlet tube.

7. A urinal as defined in claim 6, said means comprising non-uniform circumferential widths of said lugs, projections and spaces.

8. A urinal as defined in claim 7, one of said lugs and one of said spaces being narrower than the other lugs and spaces.

* * * * *